United States Patent [19]

Wang

[11] 4,006,052

[45] Feb. 1, 1977

[54] DIFFUSION METHOD FOR DEPOSITING MICROPOROUS FILM

[75] Inventor: Wu Lan Wang, Newark, N.J.

[73] Assignee: Tenneco Chemicals, Inc., Saddle Brook, N.J.

[22] Filed: Mar. 29, 1974

[21] Appl. No.: 456,352

Related U.S. Application Data

[63] Continuation of Ser. No. 223,538, Feb. 4, 1972, abandoned, which is a continuation of Ser. No. 780,988, Dec. 4, 1968, abandoned.

[52] U.S. Cl. ..... 156/280; 118/257; 156/238; 156/305; 427/246; 427/342

[51] Int. Cl.[2] ..... B05D 3/10; B05D 5/00

[58] Field of Search ..... 117/47, 161, 135.5; 260/2.5, 77.5 MP, 77.5; 264/41, 48; 118/257; 68/204; 427/428, 429, 342, 246; 156/238, 305, 280

[56] References Cited

UNITED STATES PATENTS

| | | | |
|---|---|---|---|
| 2,657,151 | 10/1953 | Censel et al. | 117/47 |
| 2,894,855 | 7/1959 | Wilham | 117/135.5 |
| 2,905,568 | 9/1959 | Burgeni | 118/257 X |
| 3,208,875 | 9/1965 | Holden | 117/135.5 |
| 3,238,055 | 3/1966 | Brightwell | 117/135.5 |
| 3,363,530 | 1/1968 | Rice | 118/257 X |
| 3,515,573 | 6/1970 | Japs et al. | 117/47 |
| 3,536,553 | 10/1970 | Farrell et al. | 117/135.5 |
| 3,539,424 | 11/1970 | Tashlick | 156/238 |

FOREIGN PATENTS OR APPLICATIONS

| | | | |
|---|---|---|---|
| 6,404,231 | 10/1964 | Netherlands | 117/161 |

*Primary Examiner*—Harry J. Gwinnell
*Attorney, Agent, or Firm*—Cooper, Dunham, Clark, Griffin & Moran

[57] ABSTRACT

Describes procedure for deposition of microporous grain layer in and on a substrate for the production of leather replacement products in which the deposition liquid diffuses upwardly through the substrate to deposit the polymer from a solution thereof which has been laminated and coated on the top surface of the substrate.

9 Claims, 1 Drawing Figure

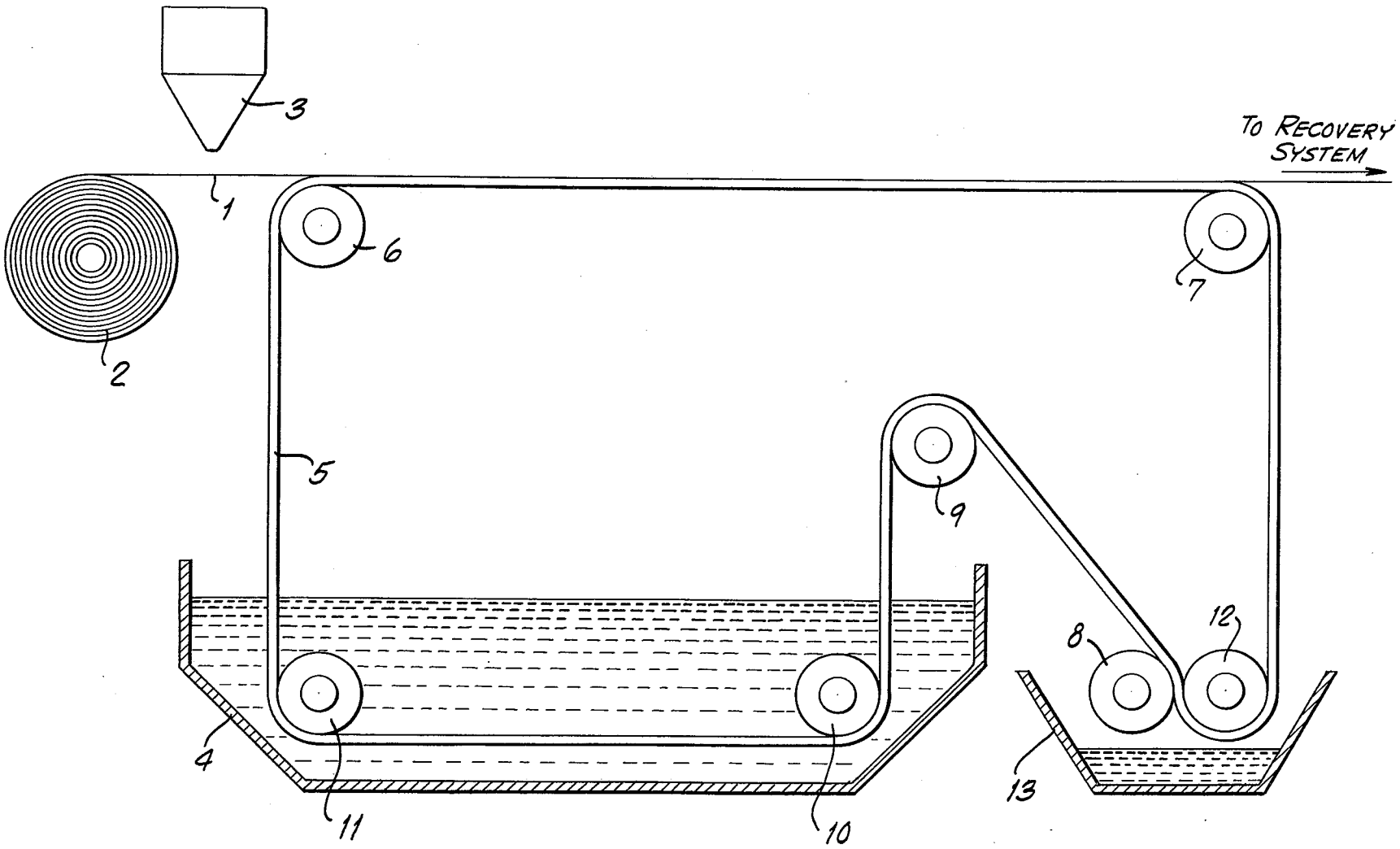
TO RECOVERY SYSTEM
1
2
3
4
5
6
7
8
9
10
11
12
13

DIFFUSION METHOD FOR DEPOSITING MICROPOROUS FILM

This application is a continuation of Ser. No. 223,538, filed Feb. 4, 1972, which is a continuation of Ser. No. 780,988, filed Dec. 4, 1968, both now abandoned.

BACKGROUND OF INVENTION

This invention is concerned with the integral deposition of vapor permeable polymeric films in and on a flexible substrate. More particularly, it is concerned with improved procedures for depositing the grain layer on substrates so as to produce products which are useful as replacements for natural leather in a variety of applications. In preferred embodiments of the invention the polymeric film is deposited on fibrous substrates.

Major advances have been made in recent years in the production of leather replacement products . . . so called artificial leathers. These products are now available in a large number of grades which are suitable for use as shoe uppers, garments, upholstery coverings, handbags, and the like. Many of these products comprise a thin, elastomeric, breathable film on a flexible fibrous substrate. Normally the film is deposited on the substrate by precipitation from an organic solution by the addition of a liquid which is miscible with the solvent, but which does not dissolve the polymer.

The process of precipitating polymer molecules from solution by introducing a non-solvent liquid for the polymer, which is miscible with the solvent of the solution, is well known. However, for the production of leather-like products it is desirable that the polymer deposit from its solution as a uniform microporous film which is substantially free of micro-voids. Microporous films, as the term is used in the art and as it is used in this application, are cellular films in which cells are so small that they are generally not visible even at 100 × magnification. Macro-voids are normally visible to the naked eye and their presence in films which are components of artificial leathers will have deleterious effects on aesthetic properties and on physical properties such as flex, tear strength, and the like, in the finished product.

A number of procedures have been devised in attempts to deposit microporous films which are substantially free of macro-voids. None of them are completely satisfactory. The best known of these methods are:

1. Exposing the wet film of polymer solution in an organic solvent to a humid atmosphere, e.g. a wet film of a dimethyl formamide solution of a polyurethane elastomer to an aqueous atmosphere having a controlled relative humidity. This is followed by bathing in a non-solvent such as water.

2. Adding water or other non-solvent to the organic solution of the polymer to convert the solution to a colloidal dispersion. The amount of non-solvent added is carefully controlled so that the polymer does not form a gel. The suspension is coated on the substrate as a wet film and deposition is completed by bathing in a non-solvent bath.

3. Adding a sufficient amount of water or other non-solvent to the polymer solution so as to form a gel. The gel is separated and coated on the substrate. Deposition is completed by bathing the coated substrate in a non-solvent bath.

4. Forming a wet film of polymer solution on a substrate and thereafter bathing the coated substrate with a mixture of an organic solvent for the polymer and a non-solvent for the polymer which is at least partially miscible with the organic solvent.

All of these methods are followed by a step in which the product is washed in additional non-solvent so as to remove substantially all of the solvent. The product is then dried.

These procedures are capable of producing microporous films substantially free of macro-voids, but the procedures are not free of drawbacks. The principal disadvantages are these:

1. The first method requires a long processing time for the deposition of a suitable film, and this adds to the cost of the procedure. Expensive air conditioning equipment is also necessary in order to control the relative humidity.

2. With the second method, the determination of the end point between the formation of the colloidal dispersion and the gel point is often quite difficult especially because of the tendency of the end point to vary appreciably from batch to batch of what are, apparently, the same polymers. This often leads to the production of final products with less than optimum physical properties. In extreme cases the solution may even be rendered useless.

3. With the third method the necessity of separating the gel adds to the cost of the procedure. Additionally, the viscosity of the gel is often so high as to cause difficulties in the coating operation.

4. In the fourth method the relatively high quantity of organic solvent which is employed often causes deleterious effects on the substrate by softening or even dissolving some of its components. Additionally, the use of such relatively large quantities of organic solvent increases the cost of the operation and may cause operational hazzards.

In view of these difficulties the art has long sought a facile, economic procedure for the preparation of microporous, elastomeric films suitable as grain layers in leather replacement products. This invention provides such a method.

Before describing the invention in more detail it will be convenient to define certain of the terms which will be employed.

Fiber:

Natural and synthetic materials of suitable denier, length and other dimensions such as polyesters, acrylics, polyamides, modacrylics, vinyls, cellulosics, wool, silk, etc. Inorganic fibers such as glass are included, but the preferred fibers for the preparation of leather-like compositions are normally organic fibers. They can be polyamides, such as polyhexamethylene adipamide (nylon 66) or polycaporamide (nylon 6); polyesters, such as polyethylene terephthalate or polydimethylcyclohexyl terephthalate; acrylics such as polyacrylonitrile; vinyls, such as polyvinyl chloride or polyvinyl alcohol; cellulosics such as rayon, etc., and wool. Mixtures of two or more fiber types may be employed.

As used herein, the term "fiber" includes tow, staple, continuous filament and similar fiber forms. The fibers may be present as yarns. They may be crimped (whether or not heat-set) or uncrimped. For the preparation of various substrates fibers employed may generally have a denier between about 0.5 and 6 and preferably between 0.5 and 3. Fiber lengths of at least about ½ inch are desirable. Fibers in conventional textile lengths, e.g. up to three or more inches, are generally suitable for the preparation of fibrous substrates.

As used herein "fiber" refers to a product which is at least 500 times as long as it is wide. This will distinguish fibers from particles which normally do not have any one dimension appreciably greater than another dimension, and are often essentially spherical.

Fleece:

The structure formed by processing the fibers in the appropriate equipment including, for example, carding, cross-layering, air-laying, etc. Excellent substrates for use in this invention are prepared from isotropic fleeces such as may be formed on air-lay equipment. However, a cross-laid fleece in conjunction with other directional structures such as carded fleece, scrim, warp yarn, and the like, can also be employed to prepare substrates. Isotropic continuous filament structures are also suitable.

Foam:

Relatively low density, porous, cellular, flexible, resilient materials. Polyurethane foam is preferred for the preparation of substrates, although rubber latex, vinyl foams and other foams having properties similar to polyurethane foams may also be used.

Web:

The product formed by combining the fleece and the foam as by needling the fleece into the foam. Reference will also be made to composite webs in which there are at least two fleece components.

Substrate:

The product formed by depositing an elastomer throughout the web. Composite substrates are formed from composite webs by elastomeric deposition.

The term "substrate" is used herein in two different senses. It is employed in the generic sense to refer to any base which is used in association with the grain layer of the invention. It is also used in the more restricted sense of the three component fiber-foam-elastomeric filler substrate which is defined in the previous paragraph. It is not believed that this will cause any confusion.

Grain layer:

The term "grain layer" is used in association with the description of this invention to describe that portion of the total structure which is analogous to the grain layer of natural leather. The grain layer may be prepared from the same elastomers used to prepare the substrates of composite substrates.

Solvent:

The liquid used to dissolve the polymer which will deposit, precipitate or coagulate to form the grain layer.

Non-solvent:

The liquid which is used to deposit the polymer from the solution. It may be water or an aqueous blend. It is normally completely miscible with the solvent. It is not necessary that the polymer be totally insoluble in the non-solvent.

Wetting liquid:

This is the liquid used to wet the substrate. Normally it will be identical with the non-solvent but this is not necessarily so. It should have substantially the same solubility characteristics with respect to the polymer, and the same miscibility characteristics with respect to the solvent, as does the non-solvent.

The foregoing rather specialized definitions are especially useful in defining the preferred leather replacement products which can be prepared in accordance with this invention in which an elastomeric film is deposited as a grain layer in the upper strata and above the surface of a fibrous substrate comprising randomly oriented fibers entangled and interlocked with each other.

THE INVENTION

This invention provides a novel, facile and economical procedure for the deposition of a vapor permeable, breathable grain layer on a suitable substrate which avoids many of the difficulties associated with the procedures described above. In accordance with this invention the polymer is deposited by a method in which a substrate wet with a wetting liquid is coated with a polymer solution and the opposite surface of the substrate is brought into contact with a source of wetting liquid. The liquid from the wet substrate diffuses into the polymer solution and precipitates the elastomer as a microporous film substantially free of macro-voids.

In an especially preferred aspect of the invention the solvent is dimethyl formamide and water serves as both the non-solvent and the wetting liquid. The invention is not limited to pure water, however, and mixtures of dimethyl formamide and water can be used as both non-solvent and wetting liquid. Organic solvents which have solubility and miscibility properties similar to dimethyl formamide can also be employed as is discussed in more detail below. The mixtures may contain from about 10% to 90% water by weight. One mixture which is especially preferred because of the results obtained is a blend of water and dimethyl formamide containing 30% by weight of the former.

It is surprising to find that water alone can be employed as the non-solvent, since previous attempts to use the liquid alone have not resulted in satisfactory products. In fact it has been the inadequacy of pure water as a precipitation medium which has led to the development of the procedures described above. A special advantage of the process of this invention is that the grain layer is deposited in and on the substrate rather than as a laminar layer on the surface of the substrate. This improves the aesthetic appearance of the product, and also improves its physical properties, especially the resistance to delamination.

According to the procedure of this invention a vapor permeable, breathable polymeric grain layer is deposited on a leather replacement product substrate by wetting the substrate with a wetting liquid, coating the top surface with a solution of the polymer in a solvent and thereafter bringing the bottom surface of the substrate into contact with a source of non-solvent (which may be identical with the wetting liquid) and allowing the wetting liquid to diffuse into the coating solution on the top surface of the substrate until the polymer deposits as a film. In a preferred aspect of the invention the coated, wetted substrate is laid on a porous carrier which is saturated with wetting liquid and in contact with a source of additional wetting liquid or other non-solvent. The substrate and the carrier are kept in contact with each other to permit the wetting liquid to diffuse through the substrate into the wet film to effect deposition of the elastomer.

Suitable porous carriers can be selected from amongst a number of known materials including wool felt, reinforced paper, polyurethane or other polymeric foams and the like. A special feature of the invention is the fact that it is not limited by the porosity of the substrate. Some substrates which are suitable for leather substitute products may be very porous and will permit molecular diffusion of the non-solvent at such a fast rate that the polymer will deposit too quickly with the result that macro-pores will form. Others may be of somewhat lesser porosity. With the former, carriers which do not readily give up their non-solvent will be utilized, while in the latter cases carriers which hold the non-solvent more tenaciously will be used. An experienced operator will have no difficulty in selecting a suitable carrier. An inexperienced operator can readily select the proper carrier after some preliminary observations of the polymeric film as it forms.

The FIGURE is a schematic illustrating one method for carrying out the invention.

In the FIGURE, substrate 1 which has been previously wet with wetting liquid is led from feed roll 2 past polymer solution supply station 3 where it is coated with a wet film of solution. It is then guided over non-solvent supply bath 4 where it comes in contact with carrier 5 which is saturated with non-solvent. The non-solvent diffused into the wetting liquid in the wet substrate to supplement the wetting liquid which has diffused into the solution coating layer to deposit the polymer. The coated substrate passes to a recovery system where the excess liquid is squeezed out and the solvent recovered. It is finally washed and dried.

The carrier 5 is an endless belt which passes into supply bath 4 guided by guide rolls 6 through 11. Guide roll 8 is adjacent a squeeze roll 12 so that the non-solvent which may be contaminated with wetting liquid and solvent can be squeezed into receiving tank 13 for recovery operations, if desired.

The elastomers utilized for the grain layer in the practice of this invention may be selected from a relatively large number of products which are commercially available or can be prepared by known methods. They can, in fact, be the same elastomers which have been utilized in the preparation of products in accordance with the four procedures set forth above. The selected elastomer will be tough, flexible, abrasion resistant, not subject to cold flow, solvent resistant and capable of deposition as a microporous breathable layer with moisture vapor transmission properties similar to those of natural leather. In the microporous film the cells will be very small, generally of an order such that they are not visible even at 100 × magnification. They will form an intercommunicating system in which a large proportion of the cells open on one or more of their neighbors. The cells communicate with each other and with both surfaces. This does not preclude the possibility that the deposited elastomer will contain some closed cells.

A convenient test for the initial evaluation of potential elastomers as films or grain layers is to deposit the elastomer from a solution by the addition of a miscible non-solvent. Typically a dimethyl formamide solution of a polyurethane elastomer containing about 20% elastomer is treated with a 70:30 dimethyl formamide-water solution to test deposit the elastomer. If the elastomer deposits as a film, this is an indication that the elastomer is in the correct molecular weight range. The film should dry to a substantially uniformly opaque microporous layer which retains its opacity indefinitely. The development of transparency indicates that the micropores of the film have collapsed demonstrating that the molecular structure is not sufficiently rigid to produce a satisfactory film.

If the dry opaque film appears to be of adequate rigidity, it is next tested for moisture vapor transmission.

Moisture vapor transmission can be tested by placing 10 ml of water in a flanged cup known as the Payne Permeability Cup. The film is placed over the cup and held in place by clamping it between a circular ring and the flange of the cup. The loaded cup is then placed in a dessicator over anhydrous calcium chloride at substantially constant ambient temperature. The cup is reweighed at the end of 24 hours to determine the weight of water which has permeated through the test film and is thus lost from the cup. This value is recorded as the moisture vapor transmission. The test is a standard test known as the Payne Permeability Test. Elastomers unsuitable for use in this invention will produce a 10 mil thick particle-free film having a density of from about 20 to 60 pounds per cubic foot and a moisture vapor transmission of from about 100 to 200 $mg/cm^2/24$ hours.

The same test may be employed to determine the moisture vapor transmission properties of the leather replacement products prepared in accordance with the invention. It should be noted, however, that the values obtained will vary somewhat depending on whether the grain layer or the opposite side of the product faces the water.

The preferred polymers for use in the invention are polyurethanes. These are a well-know class of elastomers obtained by reaction between organic polyisocyantes and an active hydrogen containing material such as polyethers and polyesters with a plurality of hydroxyl groups on the polymer chain. Dihydroxy compounds are preferred. The reaction is carried out by reacting the hydroxyl terminated compound with a molar excess of organic isocyanate to produce an isocyanate terminated prepolymer. The prepolymer is then reacted with a chain extending compound such as water, active hydrogen containing amino compounds, amino alcohols, or diols such as n-butane-diol, ethylene glycol, propylene glycol, and the like.

Suitable chain extenders include water, hydrazine, N-methyl-bis amino propylamine, dimethyl piperazine, 4-methyl-m-phenylene diamine, diaminopiperazine, ethylene diamine. Mixtures of chain extending agents can also be employed.

The prepolymer can be prepared by first mixing a molar excess of the polyisocyanate with the active hydrogen containing polymeric material and heating the mixture at about 50°–120° C. Or, the polyisocyanate can be reacted with a molar excess of the active hydrogen containing polymeric material, and the reaction product capped by reacting it with more isocyanate.

Aromatic, aliphatic and cycloaliphatic isocyanates or mixtures thereof can be used in forming the prepolymer. These include, for example, tolylene-2,4-diisocyanate; tolylene-2,6-diisocyanate; m-phenylene diisocyanate biphenylene 4,4'-diisocyanate; methylene bis-(4-phenyl isocyanate); 4-chloro-1,3-phenylene diisocyanate; naphthalene-1,5-diisocyanate; tetramethylene-1,4-diisocyanate; hexamethylene-1,6-diisocyanate; decamethylene-1,10-diisocyanate; cyclohexylene-1,4-diisocyanate; methylene bis (4-cyclohexyl isocyanate) and tetrahydronaphthalene diisocyanate. Arylene diisocyanates, that is isocyanates in which the isocyanate groups are attached to an aromatic ring, are preferred. In general, they react more readily than do alkylene diisocyanates.

Polyalkylene ether and ester glycols are preferred active hydrogen containing polymeric materials for the prepolymer formation for reasons of availability and economy. The most useful polyether glycols have a molecular weight of 300 to 5000, preferably 400 to 2000, and include, for example, polyethyleneether glycol, polypropylene ether glycol, polytetramethyleneether glycol, polyhexamethyleneether glycol, polyoctamethyleneether glycol, polynonamethyleneether glycol, polydecamethyleneether glycol, polydodecamethyleneether glycol, and mixtures thereof. Polyglycols containing several different radicals in the molecular chain such as, for example, the compound $HO(CH_2OC_2H_4O)_n$ wherein $n$ is an integer greater than 1 can also be used.

Polyester glycols which can be used in conjunction with the polyalkylene ether glycols may be produced by reacting acids, esters or acid halides with glycols. Suitable glycols are polymethylene glycols, such as ethylene-, propylene-, tetramethylene-, decamethylene glycols, substituted polymethylene glycols such as 2,2-dimethyl-1,3-propanediol, cyclic glycols such as cyclohexanediol and aromatic glycols such as xylylene glycol. Aliphatic glycols are generally preferred when maximum product flexibility is desired. These glycols are reacted with aliphatic, cycloaliphatic or aromatic dicarboxylic acids or lower alkyl esters or ester forming derivatives thereof to produce relatively low molecular weight polymers, preferably having a melting point of less than about 70° C., and molecular weights like those indicated for the polyalkyleneether glycols. Acids suitable for preparing such polyesters are, for example, succinic, adipic, suberic, sebacic, terephthalic and hexahydroterephthalic acids and the alkyl and halogen substituted derivatives of these acids.

The chain extension reaction may be carried out at a temperature up to about 80° C., but is usually effected at about room temperature, i.e. 25° C. to 35° C. During the reaction, prepolymer molecules are joined together into a substantially linear polyurethane polymer, the molecular weight of which is usually at least 5000 and sometimes as high as 300,000. The reaction can be carried out without a solvent in heavy duty mixing equipment or it can be carried out in a homogeneous solution.

Since the resulting polyurethane polymer has rubber-like elasticity, it is referred to as an "elastomer", although the degree of elasticity and rubber-like resilience may vary widely from product to product depending on the chemical structure of the polymer and the materials in combination with it.

Polyvinyl chloride may be used in conjunction with the polyurethane described above. When making a flexible shoe upper material or the like from a blend of polyurethane elastomer and polyvinyl chloride polymer, it is often preferred to employ a major proportion (over 50 weight percent) of the former and a minor porportion (less than 50 weight percent) of the latter. However, useful films are also obtainable in accordance with this invention when the elastomer blend contains a major proportion (at least 51% by weight) of polyvinyl chloride.

Various additives such as stabilizers, coloring agents, plasticizers, and the like, can be added to the elastomer solution to enhance the properties or appearance of the final product.

As stated above, the preferred solvent for the preparation of the elastomer solution is dimethyl formamide because of its high solvent power and because it is miscible with water, which is the preferred depositing or coagulating liquid. However, other solvents and solvent blends can also be employed. Dimethyl formamide and methyl ethyl ketone in various proportions form useful solvents for use in association with water. The criteria for selecting the solvent or solvent blend are that they should dissolve the elastomer and be at least partially miscible with the non-solvent and wetting liquid.

The preferred non-solvent and wetting liquid is water because it is the least expensive. Other non-solvent liquids, including aqueous blends such as water and alcohol, may be employed. It is preferred therefore that the elastomer solvent be miscible with water or aqueous blends.

The process of this invention is applicable to the flexible, porous fibrous substrates which have heretofore been suggested for use with the methods of elastomeric film deposition described above. It is especially well adopted for use with the substrates and composite substrates described and claimed in copending and commonly assigned patent application Ser. No. 734,887, filed June 6, 1968, now U.S. Pat. No. 3,634,184, the teachings of which are incorporated herein by reference. For purposes of illustration this invention will be described as applied to the preparation of leather replacement products utilizing the preferred composite substrates described in that application.

The preferred composite substrates described in that application are three component foam-fiber-filler combinations. They are prepared by a process in which a fleece is needled into a foam to form a base web. A top fleece which comprises a pair of fibers one of which is thermoplastic is then needled into the base web to form a composite web. The denier of the fibers in the top fleece may be as large as that of the fibers in the bottom fleece, but is never larger. The composite web is then subjected to a pressure treatment at elevated temperature. Normally, the treatment is effected at about 250° F. to 375° F. at a pressure of about 5 to 100 pounds per square inch during a period of from 20 seconds to five minutes.

The compressed composite web next is impregnated with a solution of elastomeric filler material, preferably a polyurethane elastomer and the filler deposited within the web. This may be accomplished by bathing the impregnated composite web in a liquid which is miscible with the solvent of the solution, but does not dissolve the elastomer. The elastomer may be any of those described above in connection with the description of elastomers suitable for the formation of a grain layer.

The composite substrate with the deposited elastomeric filler may then be dried, buffed and subjected to a mild heat treatment at about 300° F. to 350° F. at from 2 to 5 pounds per square inch pressure from about 10 to 30 seconds.

The thus formed composite substrate is especially preferred for use in this invention. It may be defined as a breathable, fibrous sheet composition having a gradient density increasing from bottom to top comprising a base web which is an interlocking network of randomly oriented and distributed fibers in a polyurethane foam with void spaces therebetween; a top fleece comprising a plurality of additional fibers bonded together at spaced apart points, said fleece being mechanically bonded to the surface of said base web, the denier of said additional fibers being no greater than the denier of the randomly oriented fibers, the additional fibers having fine interstices between them and being predominantly in a horizontal plane; and a soft, resilient elastomer filler which substantially, but not completely fills the void spaces and interstices.

The composite web typically contains about 10% to 80% fibers and 20% to 90% foam based on the total weight.

The dry elastomeric filler content of the substrate is from about 25% to 75%, by weight, the foam content about 10% to 60%, by weight, and the fiber content from about 5% to 55%, by weight, all based on the total weight of the composition. The weight of the top fleece in a composite substrate is typically about 10% to about 25% of the total weight of the composite substrate. With the usual commercially available fibers in the usual denier range the weight of thermoplastic fiber in the top fleece is from about 15% to 50%, by weight, based on the total weight of fibers in the top fleece.

A fiber is "thermoplastic" within the meaning of the term as used herein if it softens sufficiently under the heat and pressure treatments described above to form a bond with itself or with other fibers at cross-over points on cooling. Typical fibers which are within this definition include polyvinyl chloride fibers such as Vinyon, polyesters such as Fortrel, acrylics, olefins, modacrylics, acetates and tri-acetates.

As stated above, the preferred foams are polyurethane foams. This is because they are readily available, easy to work with, tough and abrasion resistant. They are prepared in accordance with known procedures by reaction between hydroxylated polyethers, polyesters and similar compounds, and organic polyisocyanates in the presence of foaming agents such as water and liquid halogenated hydrocarbons.

Flexible, cellular polyurethanes as the term is commonly used in the art, are foams which give an ultimate elongation of at least about 100% at room temperature and have the ability to deform readily under a load. Typical foams which are useful in the practice of this invention are those requiring a compression of about 3 to 100 pounds per 50 square inches to produce a 25% deflection, measurements being made on a two inch thick sample at 25° C. in accordance with ASTM test number 1564–59T for indent load deflection. The foam sheet will preferably have a tensile strength of between about 5 to 35 p.s.i., an ultimate elongation between about 100 and 400% and a tear strength of about 0.6 to 5 pounds per inch. The preferred foams will also have between about 25 and 100 cells per linear inch and a density of the order of about 0.8 to 6 pounds per cubic foot.

The flexible cellular polyurethane employed in the practice of this invention is prepared by the reaction of an organic polyisocyanate with an organic compound having at least two isocyanate-reactive hydrogen atoms. Preferably, the organic compound having at least two reactive hydrogen atoms will have a molecular weight of at least 200. It can be a polyalkylene polyether prepared by polymerizing an alkylene glycol or alkylene oxide. The useful polyethers include polyethylene glycol, polypropylene glycol, polytetramethylene glycol, copolymers of glycols with triols such as 1,2,6-hexanetriol or trimethylol propane, copolymers of two or more oxides, such as ethylene oxide-propylene oxide copolymers, etc. It can also be a polyester such as those prepared by reacting ethylene glycol, propylene glycol, tetramethylene glycol, hexanetriol, trimethylol propane and polymers thereof with dicarboxylic acids such as those derived from castor oil, tall oil fatty acids, and other fatty acids; or dicarboxylic acids such as adipic acid, succinic acid, maleic acid, phthalic acid, etc.

Useful organic polyisocyanates include arylene diisocyanates or triisocyanates, typically tolylene diisocyanate, phenylene diisocyanate, tolylene triisocyanate, benzidine diisocyanate, mesitylene diisocyanate, durylene diisocyanate, naphthalene diisocyanate, etc.; aliphatic polyisocyanates, typically hexamethylene diisocyanate, 4,4′-methylene bis-cyclohexyl isocyanate, decamethylene diisocyanate, etc. The preferred polyisocyanates are the arylene diisocyanates and particularly the commercially available 80,20 mixture of 2,4 and 2,6-tolylene diisocyanate.

The cellular polyurethanes are prepared by reacting an organic polyisocyanate, typically tolylene diisocyanate with the organic compound having reactive hydrogen atoms in the presence of a gas-producing agent. The gas-producing agent may be water, which reacts with the isocyanate to form carbon dioxide, or it may be an inert, volatile liquid or a gas. Additional components such as cell-modifiers, emulsifiers, dyes, etc. may also be present.

The preferred cellular polyurethanes are flexible cellular polyether or polyester urethanes. They may have an open-cell or closed-cell structure, but open cells are preferred. The term "open-cell" means that at least about 90% of the cells are interconnecting and free of cell-separating membranes. Open-cell cellular polyurethanes can be prepared by suitable foaming techniques or by chemically, mechanically or explosively opening the cells of a closed cell foam.

After the foam is prepared, generally in the form of a bun, it is formed into sheets suitable for use in this invention by any suitable technique such as slicing, splitting or peeling the bun. The thickness of the sheet may vary over a wide range depending upon the proposed ultimate product. For example, sheets from 0.020 to 1.5 inches may be employed. For shoe upper products the selected sheet thickness will normally be from about 0.020 to 0.125 inch.

Useful fillers or stuffing materials which may be employed in this invention include a wide variety of soft, resilient, thermoplastic or thermosetting materials including, for example, polyurethanes and copolymers of butadiene and acrylonitrile. Polyurethane elastomers prepared from various polyethers or polyesters by reaction with polyfunctional isocyanates are especially preferred. They are prepared by known procedures utilizing the same basic chemicals utilized in the production of polyurethane foams as described above, but under conditions such that they normally do not foam. They may contain various surfactants, lubricants, and the like. They are a well known class of polymeric materials and are readily available from a number of commercial producers. Usually, they are commercially available in organic liquids such as dimethyl formamide.

The process of this invention can be repeated a number of times to increase the thickness of the grain layer. It is a special feature of the invention that the layer is not built up in discrete separate layers, but rather, because of the use of the method each superposed film merges with the previously deposited film so as to become integral with it.

In an especially preferred aspect of this invention at least one of the wet layers which is laid down on the substrate will contain dispersed particles. This aspect of the invention is disclosed and claimed in copending commonly assigned application Ser. No. 719,219, filed May 5, 1968, now abandoned, the teachings of which are incorporated herein by reference.

In accordance with the invention described in that application the elastomer solution is prepared to contain inert organic or inorganic particles varying in size from about 200 Angstroms to 150 microns. The weight of particles in the solution varies from about 30 to 120 parts by weight of inert particles per 100 parts by weight of dry elastomer. The elastomer may be, for example, polyurethane or a polyurethane polyvinyl chloride blend such as has been described above. The preferred elastomeric films are prepared to contain from 50 to 80 parts by weight of inert particles having an average size of from 20 to 70 microns.

Typical of the organic and inorganic particles which may be employed in the invention are charcoal; aluminum dust and other metallic powders; leather dust; nylon; oxides of silica such as the dioxide; silicate compounds such as sodium aluminum silicate and magnesium aluminum silicate; and oxides of calcium and barium, such as barytes, and talc. These products are available commercially in suitable particle sizes, or may be purchased and ground to suitable sizes. Microporous, microcrystalline, resilient particles are preferred because of their ability to enhance the water absorption and moisture vapor transmission of products prepared utilizing them. Products prepared using them also have a more uniform cell structure in the grain layer. Microcrystalline, microporous, resilient cellulosic particles such as may be prepared by acid hydrolysis of cellulose, followed by mechanical shearing in a water slurry and drying are especially preferred. A typical process for the preparation of these particles is described in Industrial and Engineering Chemistry, vol. 54, No. 9, pages 20–29, September 1962. In order to distinguish these particularly preferred particles from other particles which can be employed in the practice of this invention, they are referred to herein as microporous, microcrystalline, resilient cellulosic particles. They are available commercially under the name Avicel from the Food Machinery Corporation.

Microcrystalline collagens such as those which are prepared from edible, bovine collagen as water insoluble acid salts are suitable. Similarly microcrystalline silicates such as the hydrated magnesium silicate which is obtained from crysotile asbestos in the form of colloidal, rod shaped, submicron particles may also be employed. These products are available from Food Machinery Corporation under the names Avitene and Avibest, respectively.

The principal function of these particles is to mask "show-through". This is a problem in which irregularities of the substrate are apparent through the polymeric coating.

If the total grain layer is to be produced by alternately coating and depositing two or more times to build up a final grain layer, it is often convenient to coat the wet substrate by transfer of a wet film to the surface thereof from a flexible release surface which may be specially treated paper or a plastic film such as polyethylene or polypropylene. The resulting package including the substrate, the wet film and the release layer may be passed through nip rolls before the elastomer is deposited. This aids in the formation of a smooth surface to serve as a base for subsequent elastomer deposition. After the elastomer has been deposited, either by dipping in a non-solvent bath such as water or by diffusion of non-solvent upwardly from a saturated support as described herein, the release layer is peeled away.

Typically, the elastomeric solution used to form the grain layers of this invention will contain from about 2% to about 45% by weight of elastomer based on the weight of the solution; and, as stated above, they may contain from about 30 to 120 parts by weight of inert particles per 100 parts by weight of elastomer.

The products produced are most useful as natural leather replacements and are normally from about 20 to 100 mils thick. The thickness of the finished grain layer above the surface will typically be from about 5% to 33% of the total thickness of the product, or from about 5 to 20 mils. As stated above the grain layer will extend into the substrate. The principal reason for this is that the elastomer solution is coated onto a wet substrate. This permits some diffusion into the substrate, but not too much since the wetting liquid has the same solubility and miscibility characteristics as the non-solvent. In this connection it should be noted that the amount of wetting liquid in the substrate is maintained at a level such that there is no surface film of wetting liquid since this would tend to prevent penetration of the elastomer into the substrate.

This invention has been principally described as applied to three component filler-foam-fabric substrates. It is applicable to other substrates such as those described for example, in U.S. Pat. Nos. 2,910,763; 2,978,785; 2,723,935; 3,067,483; 3,238,055, and 3,000,757.

The following examples are given by way of illustration only and are not intended to be limitations of this invention.

EXAMPLE 1

Fibers of 100% 1.5 denier by 1.5 inch nylon 66 are air-laid on a webbing machine to produce a fleece of 3 oz./sq. yard. This fleece is integrated with a 0.025 inch thick sheet of polyester polyurethane foam having a density of approximately 1.5 lb/cubic foot, as follows:

a. 600 penetrations per square inch from the fiber side (300 penetrations at 11/16 inch depth, 300 penetrations at 7/16 inch depth).

The web with the fiber side up is then brought into contact with a newly laid fleece of a 2:1 blend of 1.5 denier by 1.5 inch nylon 66 and 1.5 denier by 1.5 inch polyester fiber. The fleece density is 1.5 ounces per square yard. It is again passed through a needle loom with the fiber side up to produce a composite web. The penetration density is 600 penetrations per square inch at 9/32 inch depth.

The resulting composite web is compressed in a rotary press during a dwell time of one minute at a belt pressure of 5 lbs/sq. inch while applying heat to the fiber side at 315° F. to cause the ester fiber to bond to the nylon fiber at spaced apart points.

The composite web is then impregnated with a polyester polyurethane elastomer solution in dimethyl formamide having a 15% solids concentration, and passed through metering rolls so that the total wet add on is 500%. The elastomer is the reaction product of the ester of diethylene glycol and adipic acid, reacted with toluene diisocyanate to form a prepolymer which is then chain extended with p,p'-methylene dianiline. The product is sold as Helastic 1360. The impregnated web is next passed into a water bath so as to deposit the elastomer in the composite web. The water bath is equipped with rollers to move the product along. The product is washed with water by passing it through a second water bath similarly equipped with rollers and finally dried.

The dried substrate thus produced is immersed in an aqueous bath. The wetted product is squeezed through rollers to produce a wet substrate having no surface film of liquid. A solution containing 25% by weight of a polyester polyurethane elastomer in dimethyl formamide is then knife-coated onto the surface to produce a film approximately 30 mils thick. The bottom surface of the coated substrate is laid down on an endless, porous belt of wool felt which is saturated with water. Almost immediately the polymer film starts to deposit on the surface of the substrate. At the end of a few minutes it is completely deposited and the film coated substrate is then passed through squeeze rolls, and into a water tank for washing. The washed product is dried and is useful as a replacement for natural leather.

The elastomer solution utilized in the preparation of the grain layer is prepared by reacting 74 parts by weight of hydroxyl group teminated polyethylene glycol adipate having a molecular weight of about 2000, and an hydroxyl content of 1.5% at 100–110° C. for one hour with 19.75 parts by weight of p,p'-methylenediphenyl diisocyanate in dry dimethyl formamide and chain extending by reaction at 35° C. for one hour with 7.1 parts by weight of p,p'-methylene dianiline as a 30% solution in dimethyl formamide. The resulting solution contains about 25% by weight of the elastomer.

EXAMPLE 2

A polypropylene film is knife coated with a wet film 4 mils thick of the following composition:

| | Parts by weight: |
|---|---|
| Polyurethane elastomer of Example 1 (25% in DMF) | 100 |
| DMF | 25 |
| Azo oil black dye | 0.15 |
| Avicel, Technical Grade | 16 |
| Colloidal Silica - Cab-O-Sil | 1.5 |

A composite substrate identical with the substrate of Example 1 is immersed in water and squeezed through nip rolls to a total wetting liquid add on of 60%. The surface of the composite substrate is free of any surface film of liquid. The wet substrate is laminated to the coated polypropylene by passing through nip rolls. The package thus formed is held in a water bath for about 4 minutes to deposit the elastomer. The polypropylene film is then removed.

The resulting product is squeezed so that it is still wet but has no surface film of wetting liquid and a 35 mils wet film of the same composition described above for the preparation of the base grain layer is cast on the surface already carrying the base grain layer. The coated composite substrate is laid down, coated side up, on an open cell polyurethane foam that has been saturated with water. This disposition of coated substrate, foam and water is held for 10 minutes while the elastomer deposits as a thin film. The product is then washed in water and dried. The product is a supple, breathable product having a leather like appearance and feel. The grain layer is approximately 10 mils thick and when viewed in cross section is free of macrovoids. The surface is smooth and attractive. The Bally flex resistance is over 4000 cycles. The vapor permeability is 135 mg/cm$^2$/24 hrs.

The same results are obtained using wool felt as a carrier in place of polyurethane foam.

Both products are useful as shoe uppers.

EXAMPLE 3

The procedure of Example 2 is repeated except that the non-solvent and wetting liquids employed are both 70:30 mixtures by weight of dimethyl formamide and water. The properties of the product are similar to the properties of the products of Example 2.

EXAMPLE 4

Products similar to those prepared in Example 2 are prepared by following the procedure of that Example except that the solution used to prepare the 35 mils wet film is converted to a colloidal dispersion by the addition of water before the wet film is cast on to the substrate.

What is claimed is:

1. A method for forming a vapor permeable, breatheable, grain layer on the top surface of a porous natural leather replacement product substrate which comprises the steps of:

A. Coating a solution of a polyurethane elastomer in a solvent onto a release surface of a flexible sheet;

B. Wetting the said leather replacement product substrate with a wetting liquid which is miscible with the solvent of Step A, and in which the polyurethane elastomer of Step A is insoluble to produce a wetted substrate free from a surface film of wettting liquid on its top surface;

C. Laminating the product of Step A to the product of Step B so that the polyurethane solution of Step A is in contact with the top surface of the wetted substrate of Step B by bringing the said products into registry, passing through nip rolls, depositing the polyurethane elastomer as a base film on the top surface of the substrate by bathing the laminate in a separate bath of the wetting liquid, and removing said flexible sheet;

D. Applying a solution of a polyurethane elastomer in a solvent to the side of the base film carrying the deposited elastomer of Step C;

E. Bringing the uncoated bottom surface of the polyurethane elastomer solution coated substrate of Step D into registry with the top surface of a porous support which is wetted with a wetting liquid which is miscible with the solvent of Step D, and in which the polyurethane elastomer of Step D is insoluble;

F. Maintaining the contact of Step E until the polyurethane elastomer of Step D is deposited as a grain layer on the base film of Step C as a result of diffusion of said wetting liquid through the substrate;

G. Washing the resulting product and thereafter drying.

2. A method as in claim 1 wherein the solvent is dimethyl formamide.

3. A method as in claim 2 wherein the wetting liquid is a dimethyl formamide-water mixture containing 10 to 90% water by weight.

4. A method as in claim 3 wherein the wetting liquid contains 30% water by weight.

5. A method as in claim 1 wherein the wetting liquid is water.

6. A method as in claim 1 wherein the solvent is dimethyl formamide and the wetting liquid is water.

7. A method as in claim 1 wherein the polyurethane elastomer is blended with polyvinyl chloride.

8. A method as in claim 1 in which the polymer solution contains from about 30 to 120 parts by weight of inert particles per 100 parts by weight of dry elastomer in the size range of from about 200 Angstroms to 150 microns.

9. A method as in claim 8 wherein the particles are microporous, microcrystalline, resilient, cellulosic particles.

* * * * *